US006834739B2

(12) United States Patent
Iyoda et al.

(10) Patent No.: US 6,834,739 B2
(45) Date of Patent: Dec. 28, 2004

(54) VEHICLE-MOUNTED FOUR-CYCLE ENGINE CONTROL DEVICE

(75) Inventors: Eiichi Iyoda, Hamamatsu (JP); Ken Shibano, Hamamatsu (JP)

(73) Assignee: Suzuki Motor Corporation, Hamamatsu (JP)

( * ) Notice: Subject to any disclaimer, the term of this patent is extended or adjusted under 35 U.S.C. 154(b) by 136 days.

(21) Appl. No.: 10/237,102

(22) Filed: Sep. 9, 2002

(65) Prior Publication Data

US 2003/0062209 A1 Apr. 3, 2003

(30) Foreign Application Priority Data

Sep. 28, 2001 (JP) ..... 2001-303018
Dec. 5, 2001 (JP) ..... 2001-371665

(51) Int. Cl.[7] ..... B60K 28/14
(52) U.S. Cl. ..... 180/282; 123/198 D; 184/6.1
(58) Field of Search ..... 123/198 D; 180/282, 180/284, 285; 184/6.1, 6.2, 6.4–6.8; 280/755; 701/107, 112

(56) References Cited

U.S. PATENT DOCUMENTS 3,259,202 A * 7/1966 Griffeth ..... 180/283
3,601,103 A * 8/1971 Swiden ..... 123/335
4,005,724 A * 2/1977 Courtot ..... 137/38
4,275,753 A * 6/1981 Williams ..... 137/45
4,653,445 A * 3/1987 Book et al. ..... 123/198 DC
4,911,121 A * 3/1990 Barnes ..... 123/198 D
5,033,428 A * 7/1991 Sasaki ..... 123/198 D
5,154,150 A * 10/1992 Vieira ..... 123/396
5,537,961 A * 7/1996 Shigeru et al. ..... 123/90.15
5,613,571 A * 3/1997 Rank et al. ..... 180/282
5,711,273 A * 1/1998 Barnes et al. ..... 123/446
5,846,102 A * 12/1998 Nitta et al. ..... 440/1
6,419,531 B1 * 7/2002 Nanami et al. ..... 440/1

FOREIGN PATENT DOCUMENTS

JP 5-47313 6/1993

* cited by examiner

*Primary Examiner*—Paul N. Dickson
*Assistant Examiner*—Laura B. Rosenberg
(74) *Attorney, Agent, or Firm*—Greenblum & Bernstein, P.L.C.

(57) ABSTRACT

A vehicle-mounted four cycle engine control device which includes an oil pressure detecting sensor that detects a pressure of lubricating oil circulated under pressure in an engine. An oil pressure detecting sensor failure judging system judges whether or not the oil pressure detecting sensor has failed. An engine speed judging system judges whether or not a speed of the engine is equal to or above a predetermined engine speed. A pressure state judging system judges whether or not the lubricating oil pressure detected by the oil pressure detecting sensor continues to be in a state of being lower than a predetermined reference pressure for a predetermined time interval or more. An engine control system reduces the engine speed when it is respectively judged by each of the judging systems that the oil pressure detecting sensor has not failed, that the engine speed is equal to or above the predetermined engine speed, and that the lubricating oil pressure continues to be in a state of being lower than the reference pressure for a predetermined delay time or more.

9 Claims, 10 Drawing Sheets

PRIOR ART

VEHICLE-MOUNTED FOUR-CYCLE ENGINE CONTROL DEVICE

CROSS-REFERENCE TO RELATED APPLICATIONS

The present application claims priority under 35 U.S.C. §119 of Japanese Patent Application Nos. 2001-371665 filed on Dec. 5, 2001, and 2001-303018 filed on Sep. 28, 2001, the disclosures of which are expressly incorporated by reference herein in their entireties.

BACKGROUND OF THE INVENTION

1. Field of the Invention

The present invention relates to a four-cycle engine control device mounted in a vehicle such as a motorcycle, snow vehicle, or aquatic motorcycle.

2. Description of the Related Art

Conventionally, an oil pressure warning lamp driver circuit 1 of the kind shown in FIG. 13 is connected to a four cycle engine mounted in a snow vehicle, for example.

This oil pressure warning lamp driver circuit 1 includes an oil pressure switch 2 which is turned OFF when the pressure of lubricating oil circulating within the engine body (not shown) is higher than a reference pressure and turned ON when this pressure is lower than the reference pressure, and an oil pressure warning lamp 3 which is lit when the oil pressure switch 2 is ON and turns OFF when the oil pressure switch 2 is OFF. Further, an ignition switch 4 is connected to this circuit 1.

In this circuit 1, when the lubricating oil pressure is higher than the reference pressure and the oil pressure switch 2 is therefore OFF, the oil pressure warning lamp 3 remains OFF even if the ignition switch 4 is turned ON.

On the other hand, when the lubricating oil pressure is lower than the reference pressure and the oil pressure switch 2 is accordingly ON, the oil pressure warning lamp 3 is lit as a result of the ignition switch 4 being turned ON. The user is made aware of the fact that the lubricating oil pressure is abnormally low upon seeing that the oil pressure warning lamp 3 is lit, and then manually performs a protection operation such as stopping rotation of the engine or reducing the engine speed.

However, in cases where the user continues to travel having failed to notice lighting of the oil pressure warning lamp 3, problems are readily produced such as abnormal wear of bearings, e.g., such as those used for the piston rings, crankshaft, camshaft and so forth, reduced engine durability, and scorching of engine parts.

Furthermore, with a conventional structure in which the above-mentioned oil pressure switch 2 alone is provided, there is the drawback that when an apparent drop in lubricating oil pressure is attributable to failure of the above-mentioned oil pressure sensor, the engine is then stopped urgently even if a lubricating oil pressure drop has not actually occurred.

SUMMARY OF THE INVENTION

Accordingly, one object of the present invention is to provide a vehicle-mounted four cycle engine control device whereby the engine can be suitably protected while avoiding a disabling of travel as a result of failure of the oil pressure switch.

In order to achieve the above object, the present invention may have the following arrangement.

That is, the present invention includes an oil pressure detecting sensor for detecting the pressure of lubricating oil circulated under pressure in an engine body. An oil pressure detecting sensor failure judging system or arrangement is provided for judging whether or not the oil pressure detecting sensor has failed. An engine speed judging system or arrangement is provided for judging whether or not the speed of the engine is equal to or above a predetermined engine speed. A pressure state judging system or arrangement is provided for judging whether or not the lubricating oil pressure detected by the oil pressure detecting sensor continues to be in a state of being lower than a predetermined reference pressure for a predetermined time interval or more. An engine control system or arrangement is provided for immediately stopping drive of the engine or reducing the rotation of the engine to a preset engine speed when it is respectively judged by each of the judging systems or arrangements that the oil pressure detecting sensor has not failed, that the engine speed is equal to or above the predetermined engine speed and that the lubricating oil pressure continues to be in a state of being lower than the reference pressure for a predetermined delay time or more.

The action of a vehicle mounted four cycle engine control device of the arrangement described above is as below.

That is, it is judged whether or not the oil pressure detecting sensor has failed, whether or not the engine speed is equal to or above the predetermined engine speed, and whether or not the lubricating oil pressure continues to be in a state of being lower than the reference pressure for a predetermined delay time or more, respectively, and when the judgment results are that the oil pressure detecting sensor has not failed, that the engine speed is equal to or above the predetermined engine speed and that the lubricating oil pressure continues to be in a state of being lower than the reference pressure for the predetermined delay time or more respectively, the engine speed is reduced.

It is thus possible to suitably protect the engine by distinguishing a lubricating oil pressure reduction which necessitates an engine speed reduction including engine drive stoppage.

The oil pressure detecting sensor failure judging system operates according to whether or not the oil pressure detecting sensor detects that the lubricating oil pressure is higher than the reference pressure within a required failure judgment time interval after the engine is started and a complete combustion mode has been assumed, whereby it is possible to avoid a malfunction such as that of halting rotation of the engine when the oil pressure detecting sensor fails.

The present invention may also include a rollover detecting sensor for detecting vehicle rollover, a rollover judging system or arrangement for judging whether or not a vehicle rollover state continues for or exceeds a predetermined time interval, and an engine control system or arrangement for immediately stopping drive of the engine or reducing the rotation of the engine to a preset engine speed when it is judged by the rollover judging system that a vehicle rollover state continues for or exceeds the predetermined time interval.

Furthermore, the present invention may also include an oil pressure detecting sensor for detecting the pressure of lubricating oil circulated under pressure in an engine body. An oil pressure detecting sensor failure judging system or arrangement is provided for judging whether or not the oil pressure detecting sensor has failed. An engine speed judging system or arrangement is provided for judging whether or not the speed of the engine is equal to or above a predetermined engine speed. A pressure state judging system or arrangement is provided for judging whether or not the lubricating oil pressure detected by the oil pressure detecting sensor continues to be in a state of being lower than a predetermined reference pressure for a predetermined time interval or more. A rollover detecting sensor is utilized for detecting vehicle rollover. A delay time selecting system or arrangement is used for selecting a shorter delay time of delay times of two required lengths when vehicle rollover is detected by the rollover detecting sensor and selecting a longer delay time when vehicle rollover is not detected by the rollover detecting sensor. An engine control system or arrangement is provided for reducing the speed of the engine when it is respectively judged by each of these judging systems that the oil pressure detecting sensor has not failed, that the speed of the engine is equal to or above the predetermined engine speed, that the lubricating oil pressure continues to be in a state of being lower than the reference pressure for the predetermined time interval or more, and that a vehicle rollover state continues for or exceeds a selected delay time.

When the engine speed is reduced on the basis of each of the judging systems or arrangements, the engine control system is tasked with stopping drive of the engine or reducing the rotation of the engine to a preset engine speed.

The invention also provides for a vehicle-mounted four cycle engine control device that includes an oil pressure detecting sensor that detects a pressure of lubricating oil circulated under pressure in an engine. An oil pressure detecting sensor failure judging system judges whether or not the oil pressure detecting sensor has failed. An engine speed judging system judges whether or not a speed of the engine is equal to or above a predetermined engine speed. A pressure state judging system judges whether or not the lubricating oil pressure detected by the oil pressure detecting sensor continues to be in a state of being lower than a predetermined reference pressure for a predetermined time interval or more. An engine control system reduces the engine speed when it is respectively judged by each of the judging systems that the oil pressure detecting sensor has not failed, that the engine speed is equal to or above the predetermined engine speed, and that the lubricating oil pressure continues to be in a state of being lower than the reference pressure for a predetermined delay time or more.

The oil pressure detecting sensor failure judging system may operate according to whether or not the oil pressure detecting sensor detects that the lubricating oil pressure is higher than the reference pressure within a required failure judgment time interval after the engine is started and a complete combustion mode has been assumed.

The invention also provides for a vehicle-mounted four cycle engine control device that includes a rollover detecting sensor that detects vehicle rollover. A rollover judging system judges whether or not a vehicle rollover state continues for or exceeds a predetermined time interval. An engine control system reduces an engine speed when it is judged by the rollover judging system that a vehicle rollover state continues for or exceeds the predetermined time interval.

The invention still further provides a vehicle-mounted four cycle engine control device that includes an oil pressure detecting sensor that detects a pressure of lubricating oil circulated under pressure in an engine. An oil pressure detecting sensor failure that judging system judges whether or not the oil pressure detecting sensor has failed. An engine speed judging system judges whether or not the speed of the engine is equal to or above a predetermined engine speed. A pressure state judging system judges whether or not the lubricating oil pressure detected by the oil pressure detecting sensor continues to be in a state of being lower than a predetermined reference pressure for a predetermined time interval or more. A rollover detecting sensor that detects vehicle rollover. A delay time selecting system selects a shorter delay time of two different delay times of different required lengths when vehicle rollover is detected by the rollover detecting sensor and selects a longer delay time when vehicle rollover is not detected by the rollover detecting sensor. An engine control system reduces a speed of the engine when it is respectively judged by each of these judging systems that the oil pressure detecting sensor has not failed, that the speed of the engine is equal to or above the predetermined engine speed, that the lubricating oil pressure continues to be in a state of being lower than the reference pressure for the predetermined time interval or more, and that a vehicle rollover state continues for or exceeds a selected delay time.

When the engine speed is reduced on the basis of each of the judging systems, the engine control system may stop drive of the engine or reduce the rotation of the engine to a preset engine speed.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
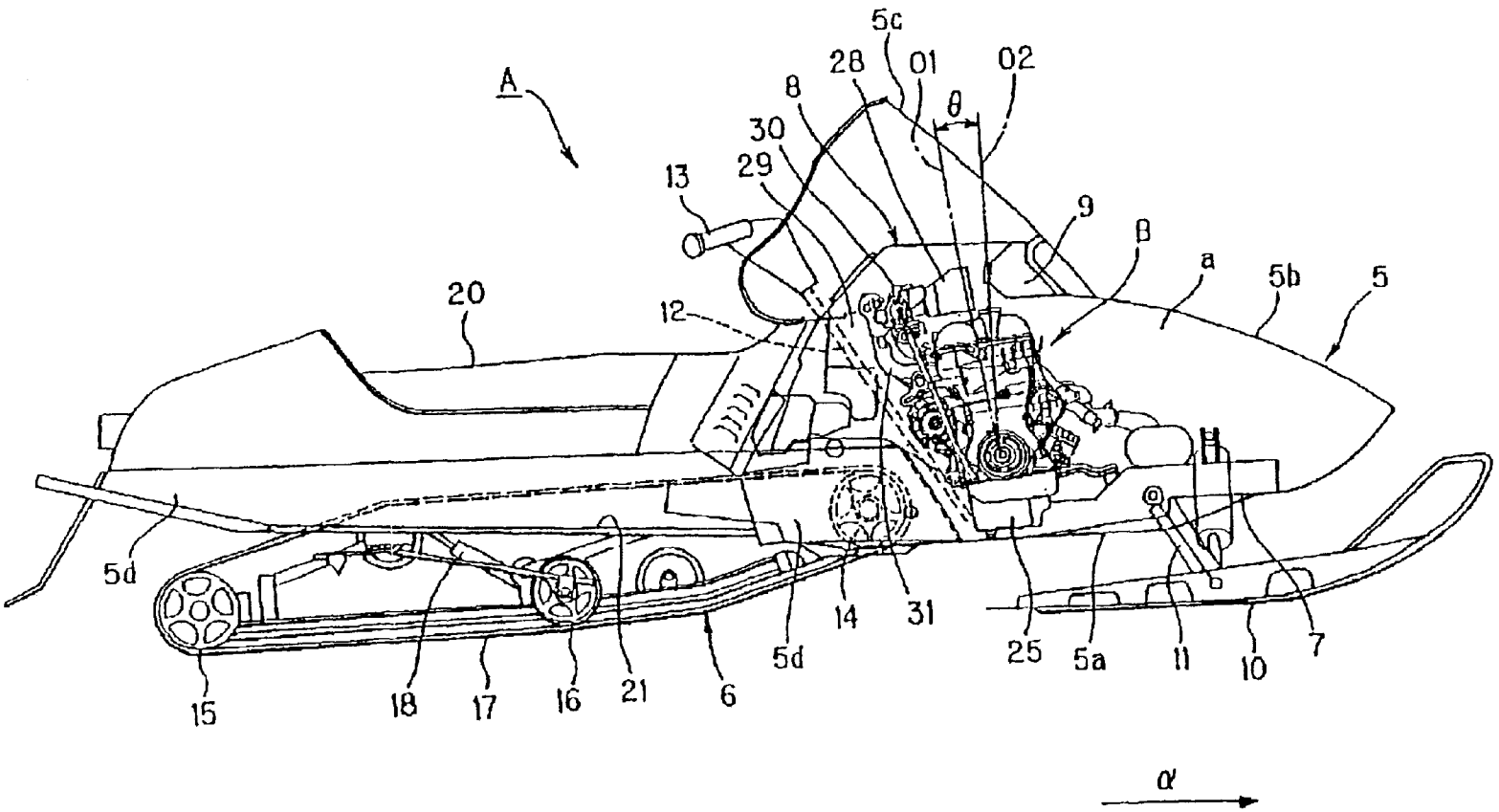
FIG. 1 shows a side view of an entire snow vehicle.
Figure 2:
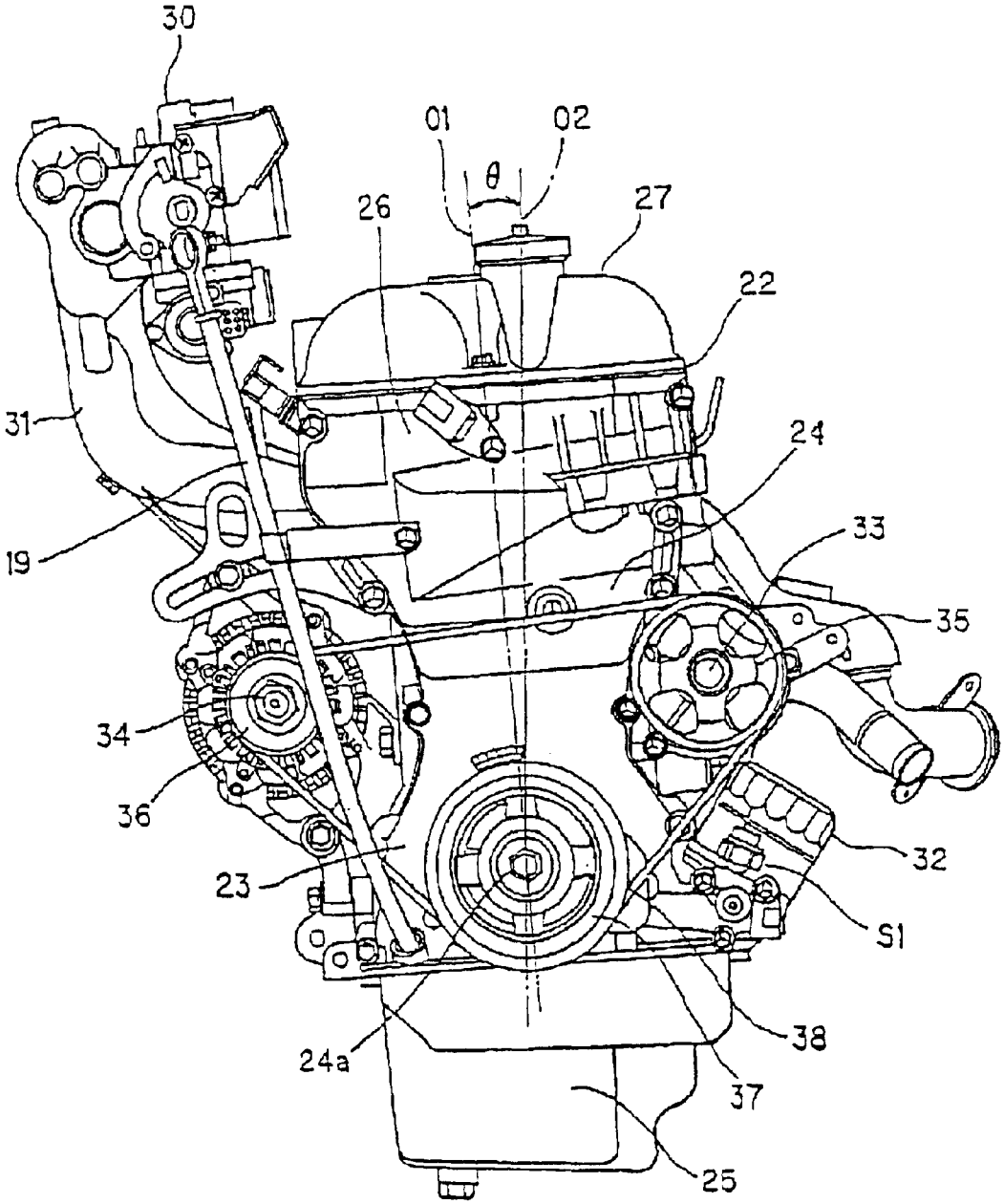
FIG. 2 shows an enlarged side view of a four cycle engine which is mounted in this same snow vehicle.

The embodiments of the present invention will be described with reference to the drawings. FIG. 1 is a side view of an entire snow vehicle and FIG. 2 is an enlarged side view of a four cycle engine which is mounted in the snow vehicle shown in FIG. 1.

Snowmobile A, which is a small snow vehicle, has a snow vehicle water-cooled four cycle engine (referred to hereinafter simply as "engine") B is disposed in the front section of the vehicle body 5 which has a monocoque structure, and a crawler 6 is disposed in the rear half section of this vehicle body 5. The details of the constitution of each of these parts is as described below.

In a planar view of the vehicle body 5, a front side lower half section 5*a* of the vehicle body 5 is formed broadly in a ship's bottom shape that tapers gradually from the rear toward the front in the forwards direction α of the vehicle body 5. An engine mount section 7 for mounting the engine B is provided on the bottom of the front side lower half section 5*a*.

In the front side upper half section of the vehicle body 5, an engine hood 5*b* formed so as to bulge slightly upward is attached in a hinged fashion such that same can be opened, the pivot thereof being arranged at the front end of the front side lower half section 5*a*. As a result, an engine room "a" is formed as a compartment in the front section of the vehicle body 5.

An instrument panel 8, on which a variety of instruments such as a speedometer/tachometer are disposed, is formed at the trailing edge of the engine hood 5*b* so as to be at a somewhat higher level than this trailing edge. A head light 9 is provided in the section which constitutes the difference in level. A wind shield 5*c* is disposed in an upright position in a state in which it extends from the front to both sides so as to encircle a frontward periphery of the instrument panel 8 and in which the top edge of the wind shield 9 is somewhat inverted in inclined fashion in a rearward direction.

Front suspension 11 (only one of the suspension devices is shown) supports a pair of skis 10 (only one of which is shown) which provide lateral steering. These are mounted on the underside of the engine mount section 7.

Further, a front suspension housing (not shown) for housing the top sections of the front suspension system 11 is integrally formed on both sides of the front side lower half section 5*a* of the vehicle body 5.

To the rear of the engine B, in other words, in a section behind the engine hood 5*b* and directly in front of a seat 20 described hereinafter, a steering post 12 is provided in an upright position, the top end thereof being inclined slightly rearward, that is, in a rearwardly inclined state. A handlebar 13 for steering the skis 10 is mounted at the top end of the steering post 12.

Both ends of a steering rod (not shown) which is below an engine body (referred to simply as "body" hereinbelow) 22 (described in detail hereinafter) and which specifically extends forwardly through a side of an oil pan 25, are linked to the lower end of the steering post 12 and to the skis 10. Thus, operation of the handlebar 13 causes the steering post 12 to steer the skis 10 via the steering rod (not shown).

A track housing 5*d* for housing the front of the crawler 6 described below is integrally formed so as to extend from the front of the middle section of the vehicle body 5 to the rear section thereof.

The crawler 6 is formed by arranging a middle wheel 16 between a drive wheel 14 which is disposed toward the front of the middle section of the vehicle body 5 and an idler wheel 15 which is disposed further toward the rear than the drive wheel 14, by winding a track belt 17 around the aforementioned wheels, and by interposing a suspension mechanism 18 between the vehicle body 5 and the vicinity of the middle wheel 16.

A saddle-shaped seat 20 is disposed in a middle top section of the vehicle body 5, and side steps 21 (one of which is not shown in the figure) are provided below both sides of the seat 20 so as to protrude outwardly in a vehicle body width direction.

The engine B will be described next in detail by also referring to FIG. 2.

The body 22 of the engine B has a cylinder block 24, in which three cylinders are positioned in a row in a vehicle body width direction. The engine B also includes a crankcase 23, and an oil pan 25 which is arranged at the bottom of the crankcase 23. The engine body 22 is disposed close to the front of the steering post 12 (see FIG. 1). Further, a cylinder head 26 is provided above the cylinder block 24. A cylinder head cover 27 is arranged on the head 26 and an oil level gauge 19 is mounted to the engine B.

The cylinder block 24 is inclined rearwards in the forwards direction α of the vehicle body 5 (see FIG. 1), in other words, the axial center O1 of the cylinder block 24 is therefore inclined rearwards from the vertical line O2 by an angle θ (i.e., a rearward inclination angle θ°) which passes through the crankshaft 24*a* that is substantially parallel with the vehicle body width direction.

Air cleaner boxes 28, 29 are provided to the rear of and above the cylinder head cover 27 and, of these air cleaner boxes 28, 29, a throttle body 30 is connected to a rear section on the other side of the air cleaner box 28 in a vehicle body width direction. An intake manifold 31 having a substantial L shape in a side view of the vehicle body is connected to the throttle body 30.

An oil filter 32 and an oil pressure switch S1 (described in detail hereinafter) are provided at the front of the crankcase 23 so as to be mutually adjacent to one another in a vehicle body width direction.

Further, a water pump 33 is arranged at the front of the cylinder block 24 and an alternator 34 is arranged at the rear thereof. The cylinder block 24 is thus arranged therebetween with the pump 33 and the alternator 34 lying substantially opposite one another, and having driven pulleys 35 and 36 attached respectively thereto.

Also, a timing belt 38 is wound around these driven pulleys 35 and 36 and around a drive pulley 37 which is provided on a crankshaft 24*a* outside the crankcase 23 such that the driven pulleys 35 and 36 and the drive pulley 37 are driven by rotation of the crankshaft 24*a*.

In a vehicle body side view, the positional relationship between the water pump 33, the alternator 34 and the crankshaft 24*a* is essentially that of an inverted triangular shape wherein the frontward water pump 33 and the rearward alternator 34 are provided in positions that are substantially mutually symmetrical about the axial center O1 of the cylinder block 24.

Figure 3:
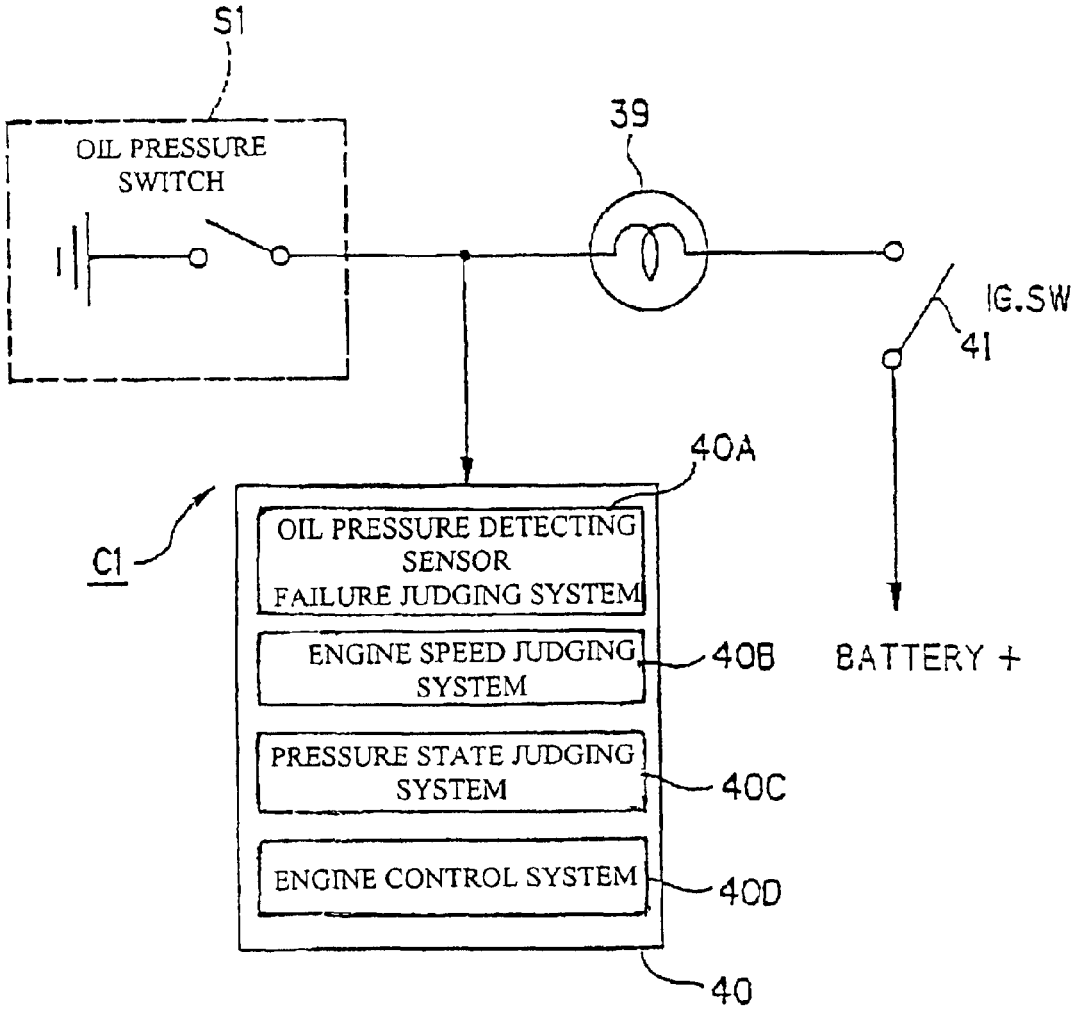
FIG. 3 shows a circuit diagram of a control device or system according to a first embodiment of the same four cycle engine.

A description will be provided next of a control device of the engine B. FIG. 3 is a circuit diagram of the control device C1 according to the first embodiment.

This control device C1 includes an oil pressure switch S1 which is an oil pressure detecting sensor and is provided at the front of the crankcase 23 as described hereinabove. An oil pressure warning lamp 39 constitutes one example of a warning instrument. An ECU (Engine Control Unit) 40 is also utilized. The control device C1 is connected to an ignition switch 41.

When the pressure of lubricating oil which is being circulated under pressure inside the engine body 22 is lower than a predetermined reference pressure, the oil pressure switch S1 is turned ON by a diaphragm (not shown) which is connected to the oil pressure switch S1, and is turned OFF by the diaphragm when this pressure is approximately equal to or above the predetermined reference pressure. When ON, an ON signal (low pressure signal) is output and, when OFF, an OFF signal (high pressure signal) is output.

The oil pressure warning lamp 39 is disposed in a position so as to be easily seen by the user, for example in the above-mentioned instrument panel 8. Also, the warning instrument is not restricted to the oil pressure warning lamp shown in the present embodiment. The invention also contemplates the use of other devices such as, e.g., a buzzer, an LED (Light Emitting Diode) or a sound emitting device, for example.

The above-mentioned ECU 40 has the following functions:

1) A function for judging whether or not the oil pressure switch S1 has failed (oil pressure detecting sensor failure judging system or arrangement 40A).

The ECU 40 operates according to whether or not the oil pressure switch S1 detects that the lubricating oil pressure is higher than the reference pressure, e.g., of approximately 30 Kpa, within a required failure judgment time interval after the engine B is started and a complete combustion (combustion continues without misfiring) mode has been assumed.

Figure 4:
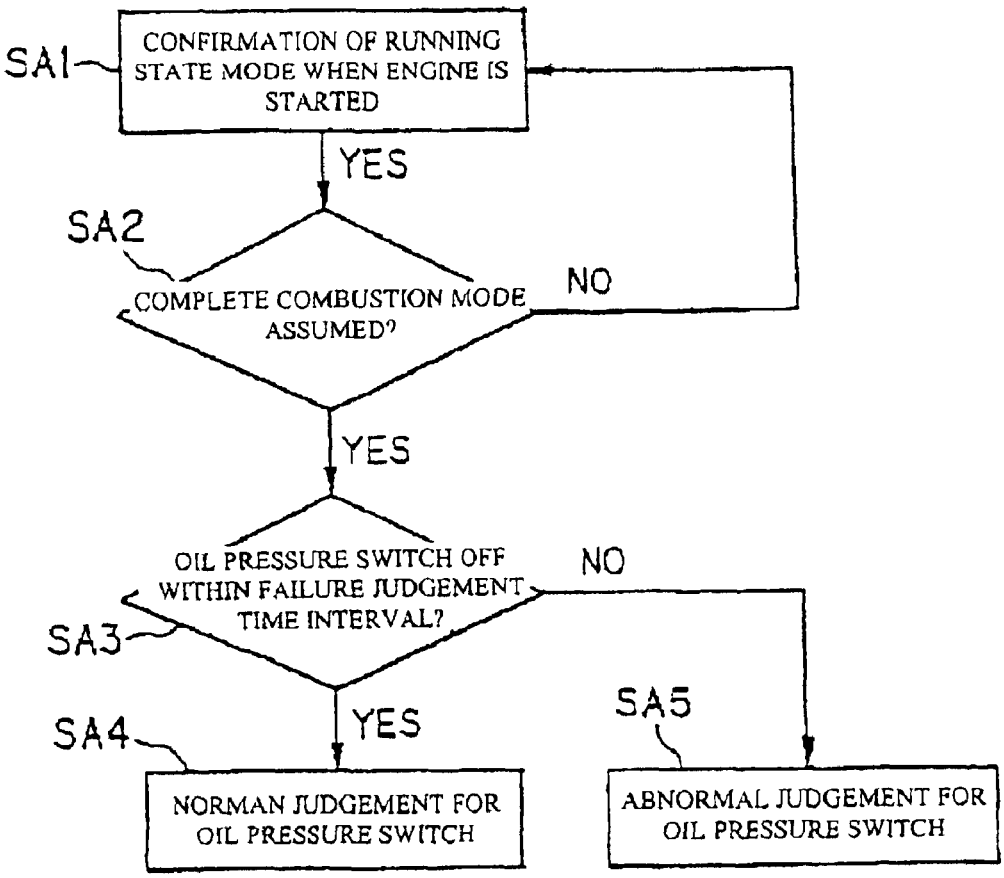
FIG. 4 shows a flowchart for judging failure of the oil pressure switch.

In other words, the ECU 40 is tasked with detecting whether or not the oil pressure switch S1 is turned OFF within a required failure judgment time interval, after the engine B is started, and, more specifically, executes each of the steps in the flowchart shown in FIG. 4.

Step 1 (abbreviated as SA1 in FIG. 4, similarly hereinbelow): After confirming a running state mode when the engine B starts, the ECU 40 proceeds to step 2.

Step 2: The ECU 40 detects whether or not a complete combustion mode has been assumed, proceeding to step 3 if the complete combustion mode has been assumed and returning to step 1 if the complete combustion mode has not been assumed.

In the detection of whether or not the complete combustion mode has been assumed, it can be judged, for example, whether the rotational speed of the crank is equal to or above a predetermined rotational speed, e.g., of approximately 1000 rpm.

step 3: The ECU 40 detects whether or not the oil pressure switch S1 is turned OFF within a failure judgment time interval and, if the oil pressure switch S1 is turned OFF thus, proceeds to step 4 and makes the judgment that the oil pressure switch S1 has not failed (normal judgment).

Also, if the oil pressure switch S1 is not turned OFF within a failure judgment time interval, the ECU 40 proceeds to step 5 and makes the judgment that the oil pressure switch S1 has failed (abnormal judgment).

2) A function for judging whether or not the speed of the engine B is equal to or above a predetermined engine speed (engine speed judging system or arrangement 40B).

3) A function for judging whether or not the lubricating oil pressure detected by the oil pressure detecting sensor S1 continues to be in a state of being lower than a predetermined reference pressure for a predetermined time interval, e.g., of approximately 2 seconds, or more (pressure state judging system or arrangement 40C).

4) A function for reducing the speed of the engine B when it is respectively judged by each of the above-mentioned judging systems or arrangements that the oil pressure detecting sensor S1 has not failed, that the speed of the engine B is equal to or above the predetermined engine speed, and that the lubricating oil pressure continues to be in a state of being lower than the reference pressure for a predetermined delay time or more (engine control system or arrangement 40D).

Here, a reduction in the engine speed includes stopping the drive of the engine B or reducing the rotation of the engine to a preset engine speed, for example the idling speed or similar.

Figure 5:
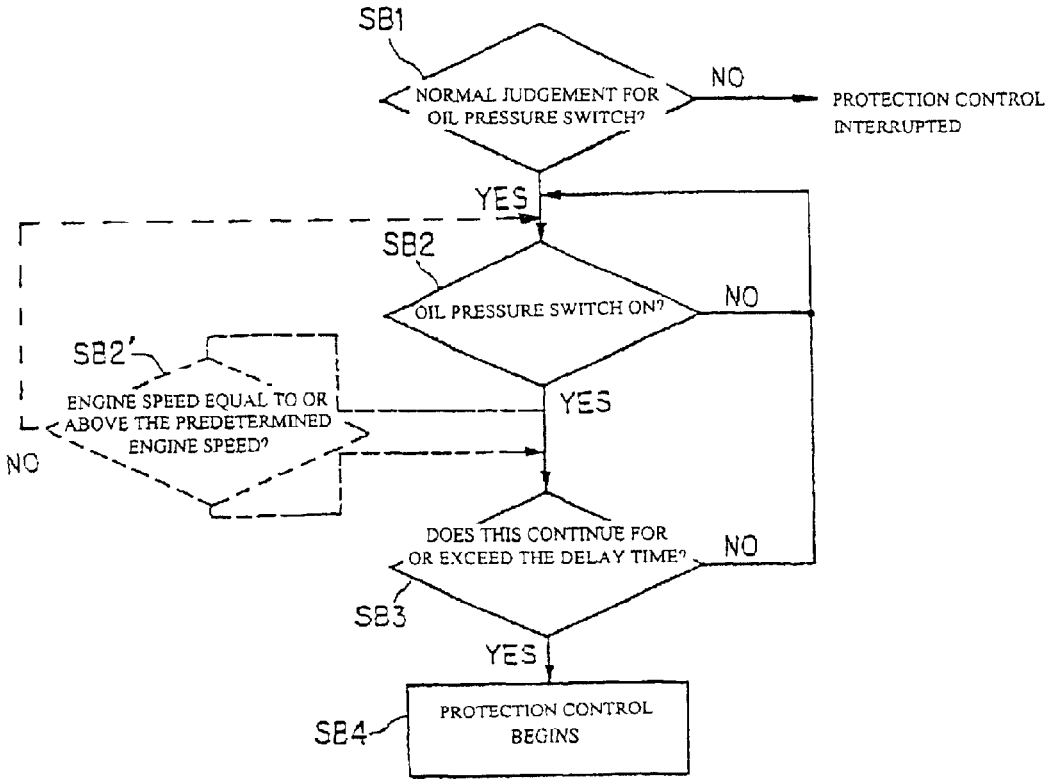
FIG. 5 shows a flowchart for an engine protection control operation.

A description will be provided for the operation of the control device C1 having the constitution described above, with reference also to FIG. 5.

step 1 (abbreviated as SB1 in FIG. 5; similarly hereinbelow): The ECU 40 judges as described hereinabove whether or not the oil pressure switch S1 has failed. In this judgment, if it is judged that the oil pressure switch S1 is OFF, that is, has not failed, the ECU 40 proceeds to step 2, and if it is judged that the oil pressure switch S1 is ON, that is, has failed, the ECU 40 performs processing to interrupt the protection control operation for engine B.

step 2: The ECU 40 detects an ON/OFF state of the oil pressure switch S1, proceeding to step 3 if the oil pressure switch S1 is ON, and repeating step 2 if same is OFF.

step 3: The ECU 40 judges whether or not an ON state continues for a predetermined delay time or more, proceeding to step 4 if it is judged that such a state has continued thus, and returning to step 2 if it is judged that such a state has not continued thus.

step 4: The ECU 40 performs protection control for engine B. Specifically, the ECU 40 stops drive of the engine B or reduces the engine speed to a predetermined engine speed (to the idling speed, for example) in accordance with a fuel cut misfiring, or air quantity control, or the like.

Further, between the above steps 2 and 3, a step 2' may also be provided in which the ECU 40 judges whether or not the rotation of the engine B is equal to or above the predetermined engine speed, and when the engine speed is equal to or above the predetermined engine speed, the ECU 40 proceeds to step 3, and when this is not the case, the ECU 40 interrupts a protection control operation for the engine B.

Figure 6:
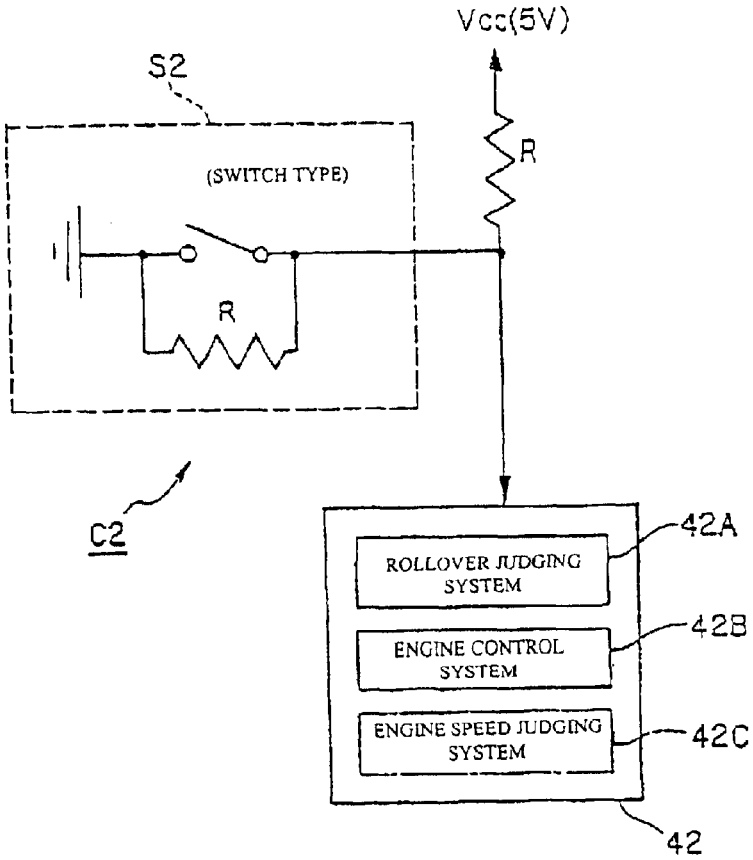
FIG. 6 shows a block diagram showing a circuit configuration of a control device or system according to a second embodiment of the same four cycle engine.

A description follows of a control device according to the second embodiment, with reference to FIG. 6. FIG. 6 is a block diagram of a control device C2 according to the second embodiment.

The control device C2 includes a rollover detecting sensor S2, which is disposed in the center section of the above-described vehicle body 5, and an ECU (Engine Control Unit) 42.

The rollover detecting sensor S2 is of a so-called switch type produced by inserting a slider with clearance inside a switch body so as to be capable of sliding reciprocatingly therein in a vehicle body width direction (neither the slider nor switch body is shown in the drawings). This sensor S2 is constituted so as to be turned ON or OFF by movement of the slider when inclination of the vehicle body 5 is greater than a preset angle.

Figure 7:
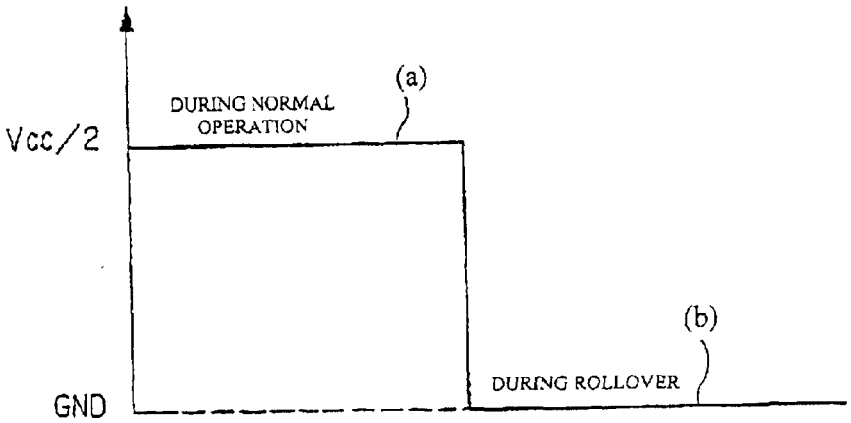
FIG. 7 shows a waveform diagram for a rollover signal which is output by the rollover detecting sensor.

Normally (when there is no rollover) the rollover detecting sensor S2 is OFF and the high level signal indicated by (a) in FIG. 7 is input to the ECU 42. When rollover occurs, the sensor S2 is turned ON and a low level rollover signal indicated by (b) is input to the ECU 42.

The ECU (Engine Control Unit) 42 has the following functions:

1) A function for judging whether or not a vehicle rollover state continues for or exceeds a predetermined time interval, e.g., of approximately 2 seconds (rollover judging system or arrangement 42A).

Specifically, the ECU 42 judges whether or not a rollover signal which is output from the rollover detecting sensor S2 continues for or exceeds a predetermined time interval.

2) A function for reducing the speed of the engine B to, e.g., 3000 rpm, when it is judged by the rollover judging system or arrangement 42A that a vehicle rollover state continues for or exceeds a predetermined time interval (engine control system or arrangement 42B)

Figure 8:
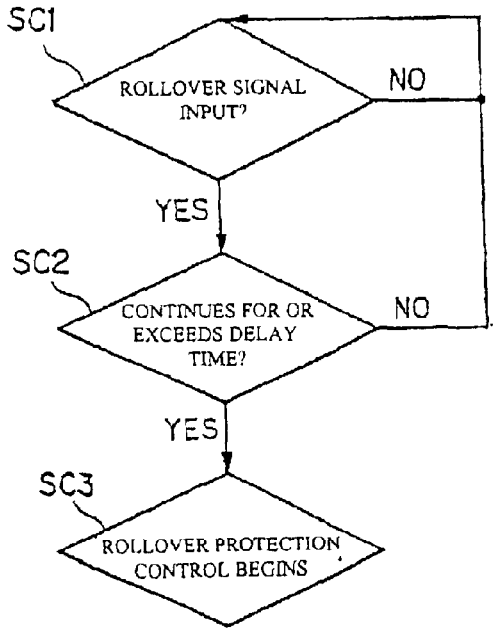
FIG. 8 shows a flowchart illustrating a protection control operation for a four cycle engine during rollover.

Specifically, judgment can be performed by the procedure illustrated in the flowchart shown in FIG. 8.

step 1 (abbreviated as SC1 in FIG. 8; similarly hereinbelow): the ECU 42 judges whether or not a rollover signal is output from the rollover detecting sensor S2, proceeding to step 2 if the rollover signal is output, and, if the rollover signal is not output, the ECU 42 repeats step 1 to monitor outputting of a rollover signal.

step 2: the ECU 42 judges whether or not a rollover signal output continues for or exceeds a predetermined time interval; if the output continues for or exceeds this time interval, the ECU 42 proceeds to step 3, and if the output does not continue for or exceed this time interval, the ECU 42 returns to step 1 to monitor outputting of a rollover signal.

step 3: the ECU 42 performs a protection control operation for the engine B. Specifically, the ECU 42 immediately stops rotation of the engine B in accordance with a fuel cut, misfiring, or the like.

Furthermore, an engine speed detecting sensor (not shown) for detecting the engine speed and an engine speed judging system or arrangement 42C (shown in FIG. 6) for judging whether or not the engine speed detected by the engine speed detecting sensor is equal to or above a predetermined engine speed, are provided, and the engine speed can also be reduced when the engine speed is equal to or above the predetermined engine speed and it is judged by the rollover judging system or arrangement 42A that a vehicle rollover state continues for or exceeds a predetermined time interval.

Figure 9:
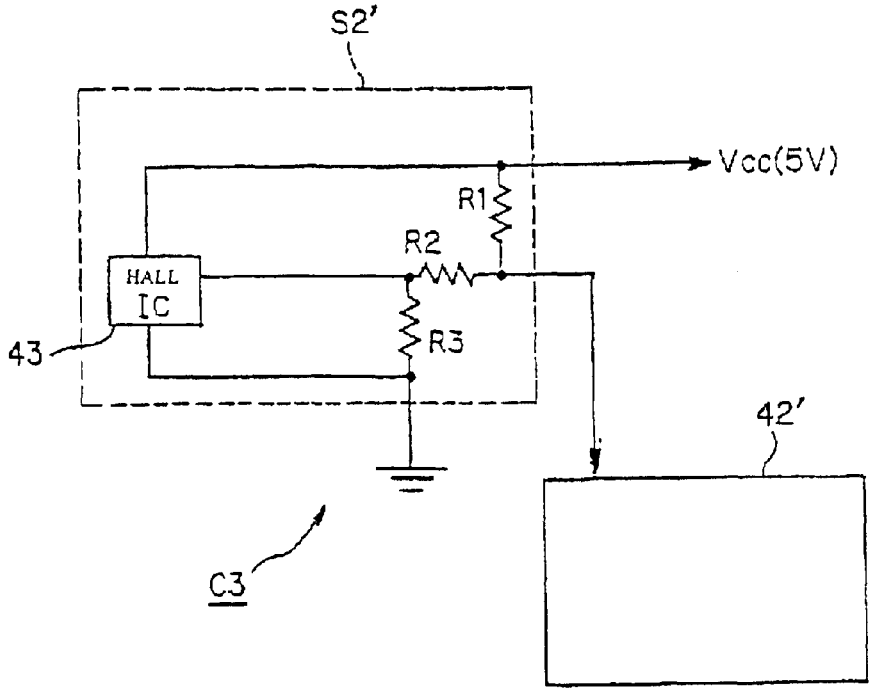
FIG. 9 shows a block diagram showing a circuit configuration of a control device according to a third embodiment of the same four cycle engine.
Figure 10:
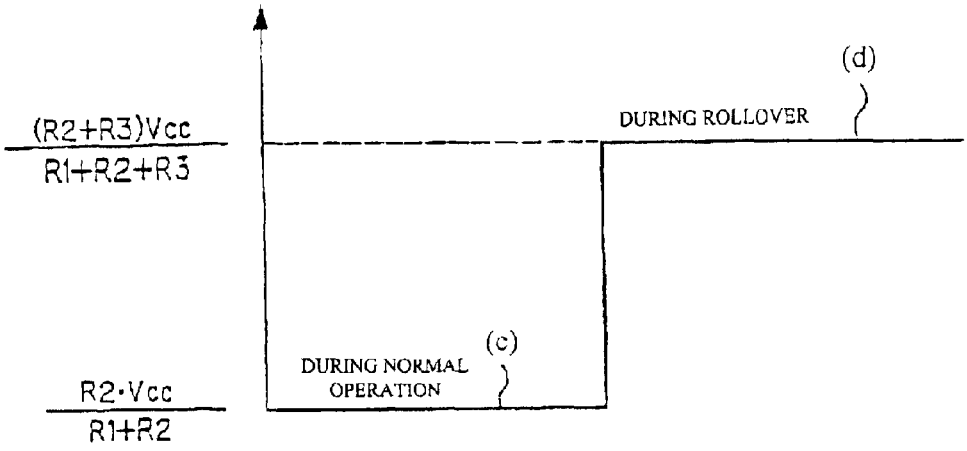
FIG. 10 shows a waveform diagram for a rollover signal which is output from the rollover detecting sensor.

A description will be provided for a control device C3 according to the third embodiment, with reference to FIGS. 9 and 10. FIG. 9 is a block diagram of the control device according to the third embodiment and FIG. 10 is a waveform diagram for an output from the rollover detecting sensor.

This control device C3 includes a rollover detecting sensor S2', which is disposed in the center section of the above-described vehicle body 5, and an ECU (Engine Control Unit) 42'. With the exception of differences in the constitution of the rollover detecting sensor S2', the constitution is the same as that for the control device C2 according to the second embodiment described above. Thus, the rollover detecting sensor S2' alone is described here, a description of other constituent elements which are the same having been omitted, which elements have been assigned the same reference numerals to which "'" has been added.

A Hall IC 43 has been employed for the rollover detecting sensor S2' which is constituted so as to output a rollover signal when inclination of the above-described vehicle body 5 is greater than a preset angle, e.g., approximately 60 degrees.

When such a rollover detecting sensor S2' is used, normally (when there is no rollover) the low level signal indicated by (c) in FIG. 10 is input to an ECU 42', and during rollover, a high level rollover signal indicated by (d) is input to the ECU 42'.

Figure 11:
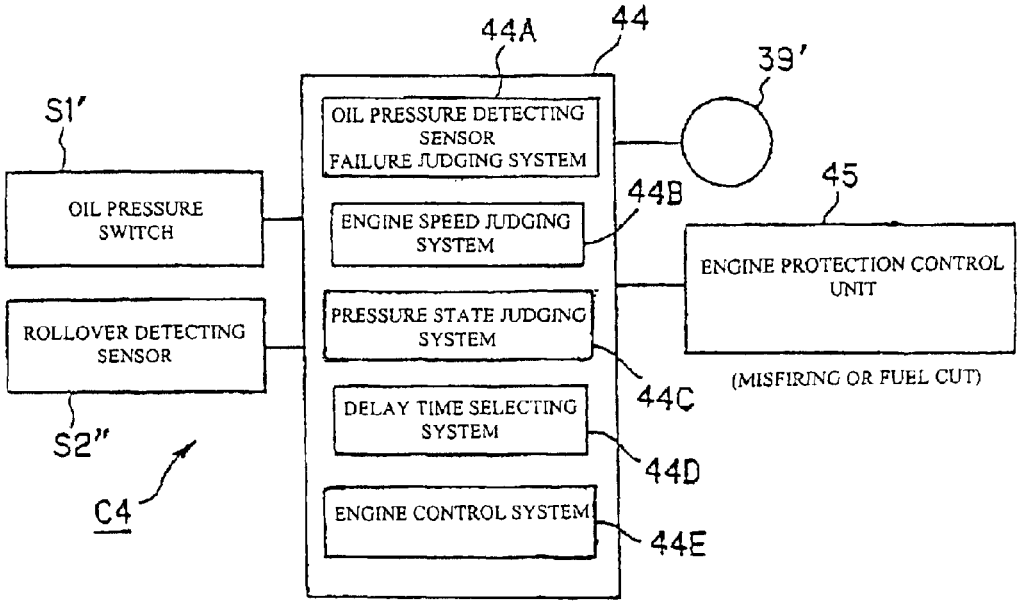
FIG. 11 shows a block diagram showing a circuit configuration for a control device according to a fourth embodiment of the same four cycle engine.
Figure 12:
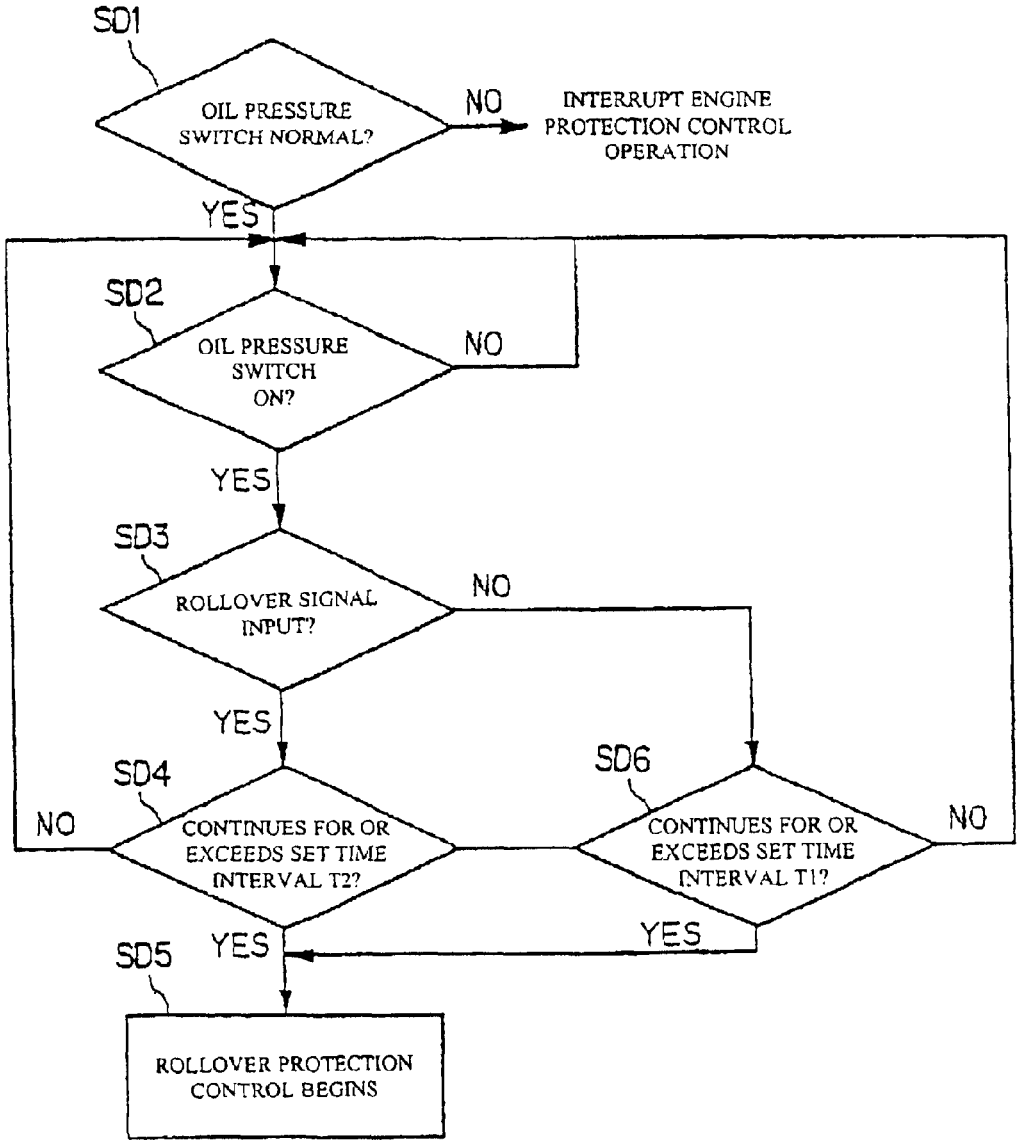
FIG. 12 shows a flowchart showing a protection control operation for a four cycle engine during rollover.
Figure 13:
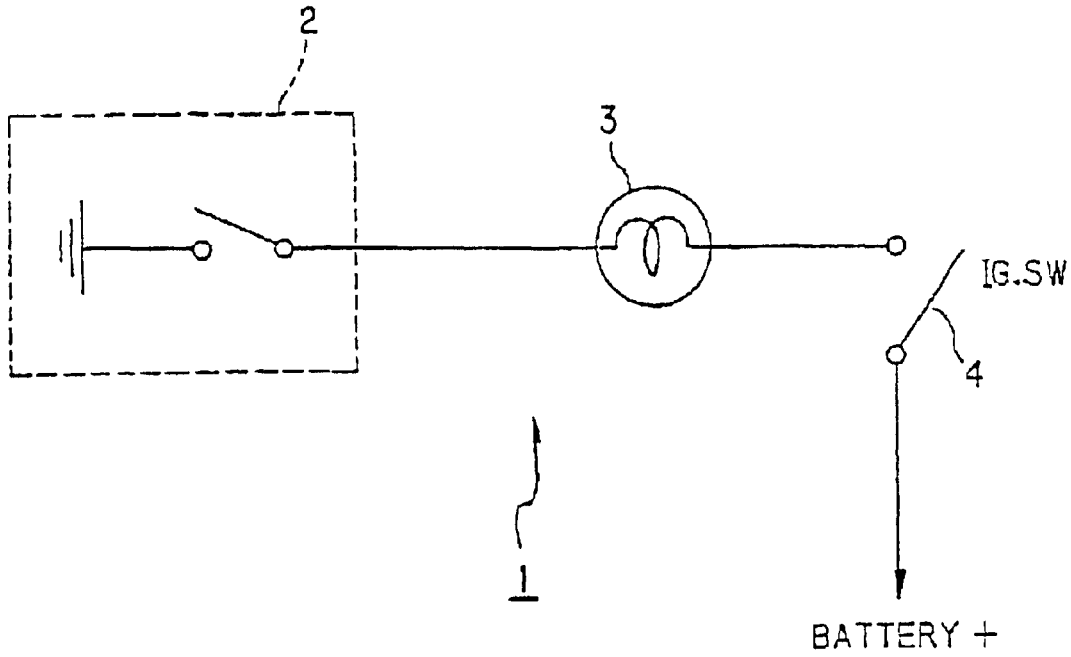
FIG. 13 shows a block diagram showing a circuit configuration of a control device of a conventional four cycle engine.

A description will be provided for a control device according to the fourth embodiment, with reference to FIGS. 11 and 12. FIG. 11 is a block diagram of a control device C4 according to a fourth embodiment and FIG. 12 is a flowchart showing an engine protection control operation.

This control device C4 is such that a rollover detecting sensor S2" and an oil pressure switch S1' constituting an oil pressure detecting sensor, which are provided at the front of the cylinder block 24, are connected to the input side of an ECU (Engine Control Unit) 44, an oil pressure warning lamp 39', which is one example of a warning instrument, and an engine protection control unit 45, which controls a fuel cut, misfiring and the like, being connected to the output side of the ECU 44.

The ECU (Engine Control Unit) 44 has the following functions:

1) A function for judging whether or not the oil pressure switch S1' constituting an oil pressure detecting sensor has failed (oil pressure detecting sensor failure judging system or arrangement 44A).

The details of this failure judgment are substantially similar to those for the operation described in FIG. 4 above.

2) A function for judging whether or not the speed of the engine B is equal to or above the predetermined engine speed, e.g., of approximately 3000 rpm (engine speed judging system or arrangement 44B).

3) A function for judging whether or not the lubricating oil pressure detected by the above-described oil pressure detecting sensor S1' continues to be in a state of being lower than a predetermined reference pressure of, e.g., approximately 30 Kpa, for a predetermined time interval of, e.g., approximately 2 seconds, or more (pressure state judging system or arrangement 44C).

4) A function for selecting a shorter delay time T2 of delay times T1, T2 (T1>T2) of two required lengths when vehicle rollover is detected by the rollover detecting sensor S2" and selecting a longer delay time T1 when vehicle rollover is not detected by the rollover detecting sensor S2" (delay time selecting system or arrangement 44D)

5) A function for reducing the speed of the engine B when it is respectively judged by each of the above judging system or arrangement that the oil pressure switch S1', which is an oil pressure detecting sensor, has not failed, that the speed of the engine B is equal to or above the predetermined engine speed of, e.g., approximately 3000 rpm, that the lubricating oil pressure continues to be in a state of being lower than the reference pressure of, e.g., approximately 30 Kpa, for a predetermined time interval of, e.g., approximately 2 seconds, or more, and that a vehicle rollover state continues for or exceeds a selected delay time (engine control system or arrangement 44E).

A description will be provided for the operation of the control device C4 having the constitution described above, with reference to FIG. 12.

step 1 (abbreviated as SD1 in FIG. 12; similarly hereinbelow): the ECU 44 judges, as described hereinabove, whether or not the oil pressure switch S1' has failed. In this judgment, if it is judged that the oil pressure switch S1' is OFF, that is, has not failed, the ECU 44 proceeds to step 2, and if it is judged that the oil pressure switch S1' is ON, that is, has failed, the ECU 44 performs processing to interrupt the protection control operation for the engine.

step 2: The ECU 44 detects an ON/OFF state of the oil pressure switch S1', proceeding to step 3 if the oil pressure switch S1' is ON, and repeating step 2 if same is OFF.

step 3: The ECU 44 judges whether or not a rollover signal is output from the rollover detecting sensor S2" and if it is judged here that a rollover signal is output, the ECU 44 proceeds to step 4, and if a rollover signal is not output, proceeds to step 6.

step 6: The ECU 44 judges whether or not the rollover signal continues for or exceeds the set time interval T1, and if it is judged that the rollover signal continues thus, the ECU 44 proceeds to step 5, and if it is judged that the rollover signal does not continue thus, returns to step 2.

step 4: The ECU 44 judges whether or not the rollover signal continues for or exceeds the set time interval T2, and if it is judged that the rollover signal continues thus, the ECU 44 proceeds to step 5, and if it is judged that the rollover signal does not continue thus, returns to step 2.

step 5: The ECU 44 performs a protection control operation for engine B. Specifically, the ECU 44 stops the engine B or reduces the engine speed to a predetermined engine speed in accordance with control of a fuel cut, misfiring or the air quantity.

Conventionally, at the time of a shock when the vehicle body jumps and lands or in a sudden turn, there was the risk that the rollover detecting sensor would be turned ON in error, and it was problematic to set the angle at which the rollover detecting sensor would be turned ON and to set the delay time for recognition of rollover. However, as shown in the present embodiment, the delay times at the time of rollover and no rollover can be varied by way of signals of the rollover detecting sensor and the oil pressure switch. Thus, reliability of the protection control operation for the engine B can be improved.

The present invention is not limited to or by the embodiments described hereinabove, the following modified embodiments also being possible.

For example, when an LED, buzzer or monitor is provided and it is judged by the oil pressure detecting sensor failure judging system whether or not the oil pressure detecting sensor has failed, it is possible to cause the LED to be lit with respect to a predetermined pattern, to cause the buzzer to sound, or to cause a message or the like communicating the fact that failure has occurred to be displayed on a monitor. It is thus possible to inform the user that the oil pressure detecting sensor has failed.

According to the embodiments described herein, a judgment is performed for failure of the oil pressure detecting sensor and for the engine speed, and it is judged whether or not the lubricating oil pressure continues to be in a state of being lower than a reference pressure for a predetermined delay time or more. When the judgment results are that the oil pressure detecting sensor has not failed, that the engine speed is equal to or above the predetermined engine speed and that the lubricating oil pressure continues to be in a state of being lower than the reference pressure for the predetermined delay time or more respectively, the engine speed is reduced, meaning that the engine can be suitably protected by distinguishing a lubricating oil pressure reduction which necessitates stoppage of the engine.

The ability to judge the presence or absence of failure of the oil pressure detecting sensor makes it possible to eliminate malfunctions based on failure of the oil pressure detecting sensor and permits normal travel even when the oil pressure detecting sensor fails.

In addition to the above-described common effects obtained by the embodiments described herein, a number of effects can be obtained.

According to one aspect of the invention, it is judged whether or not the oil pressure detecting sensor detects that the lubricating oil pressure is higher than the reference pressure within a required failure judgment time interval after the engine is started and a complete combustion mode has been assumed, meaning that it is possible to prevent a malfunction such as that of performing protection control by way of an oil pressure reduction when the engine is restarted, for example.

According to another aspect of the invention, the present invention includes a rollover detecting sensor for detecting vehicle rollover; a rollover judging system for judging whether or not a vehicle rollover state continues for or exceeds a predetermined time interval, and an engine control system for reducing the engine speed when it is judged by the rollover judging system that a vehicle rollover state continues for or exceeds the predetermined time interval. As a result, it is possible to prevent scorching arising from a deficiency in lubricating oil circulation when the vehicle rolls over.

According to another aspect of the invention, the present invention includes a delay time selecting system for selecting a shorter delay time of delay times of two required lengths when vehicle rollover is detected by the rollover detecting sensor and selecting a longer delay time when vehicle rollover is not detected by the rollover detecting sensor. In this way, when the vehicle rolls over, the rotation of the engine can be rapidly reduced and reliability of a protection control operation for the engine can be improved.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A vehicle-mounted four cycle engine control device, comprising;

an oil pressure detecting sensor that detects a pressure of lubricating oil circulated under pressure in an engine;

an oil pressure detecting sensor failure judging system that judges whether or not the oil pressure detecting sensor has failed;

an engine speed judging system that judges whether or not a speed of the engine is equal to or above a predetermined engine speed;

a pressure state judging system that judges whether or not the lubricating oil pressure detected by said oil pressure detecting sensor continues to be lower than a predetermined reference pressure for at least a predetermined time interval; and an engine control system that reduces said engine speed when it is respectively judged by each of said judging systems that said oil pressure detecting sensor has not failed, that the engine speed is equal to or above the predetermined engine speed, and that the lubricating oil pressure continues to be lower than the reference pressure for a predetermined delay time or more.

2. The vehicle-mounted four cycle engine control device according to claim 1, wherein the oil pressure detecting sensor failure judging system operates according to whether or not the oil pressure detecting sensor detects that the lubricating oil pressure is higher than the reference pressure within a required failure judgment time interval after the engine is started and a complete combustion mode has been assumed.

3. The vehicle-mounted four cycle engine control device according to claim 1, wherein, when the engine speed is reduced on the basis of each of the judging systems, the engine control system stops the engine or reduces the rotation of the engine to a preset engine speed.

4. A vehicle-mounted four cycle engine control device, comprising;

a rollover detecting sensor that detects vehicle rollover;

a rollover judging system that judges whether or not a vehicle rollover state continues for at least a predetermined time interval; and an engine control system that is configured to reduce an engine speed to a preset engine speed that is greater than zero when it is judged by the rollover judging system that a vehicle rollover state continues for at least the predetermined time interval.

5. The vehicle-mounted four cycle engine control device according to claim 4, wherein said engine control system is configured to reduce the engine speed when it is determined that the engine speed is equal to or above a predetermined engine speed.

6. The vehicle-mounted four cycle engine control device according to claim 4, wherein the engine control system is further configured to set the engine speed to zero.

7. The vehicle-mounted four cycle engine control device according to claim 4, further comprising;

an engine speed judging system that judges whether or not a speed of the engine is equal to or above a predetermined engine speed;

wherein said engine control system is configured to reduce the engine speed on the basis of each of the judging systems.

8. A vehicle-mounted four cycle engine control device, comprising;

an oil pressure detecting sensor that detects a pressure of lubricating oil circulated under pressure in an engine;

an oil pressure detecting sensor failure judging system that judges whether or not the oil pressure detecting sensor has failed;

an engine speed judging system that judges whether or not the speed of the engine is equal to or above a predetermined engine speed;

a pressure state judging system that judges whether or not the lubricating oil pressure detected by said oil pressure detecting sensor continues to be lower than a predetermined reference pressure for at least a predetermined time interval;

a rollover detecting sensor that detects vehicle rollover;

a delay time selecting system that selects a shorter delay time of two delay times of different lengths when vehicle rollover is detected by the rollover detecting sensor and selects a longer delay time when vehicle rollover is not detected by the rollover detecting sensor; and an engine control system that reduces a speed of the engine when it is respectively judged by each of these judging systems that the oil pressure detecting sensor has not failed, that the speed of the engine is equal to or above the predetermined engine speed, that the lubricating oil pressure continues to be lower than the reference pressure for at least the predetermined time interval or more, and that a vehicle rollover state continues for at least selected delay time.

9. The vehicle-mounted four cycle engine control device according to claim 8, wherein, when the engine speed is reduced on the basis of each of the judging systems, the engine control system stops the engine or reduces the rotation of the engine to a preset engine speed.

* * * * *

UNITED STATES PATENT AND TRADEMARK OFFICE

CERTIFICATE OF CORRECTION

PATENT NO. : 6,834,739 B2
DATED : December 28, 2004
INVENTOR(S) : E. Iyoda et al.

It is certified that error appears in the above-identified patent and that said Letters Patent is hereby corrected as shown below:

Column 14,
Line 45, after "least" insert -- a --.

Signed and Sealed this

Twenty-third Day of August, 2005

JON W. DUDAS
*Director of the United States Patent and Trademark Office*